US008024947B2

(12) United States Patent
Andia Laborda et al.

(10) Patent No.: US 8,024,947 B2
(45) Date of Patent: Sep. 27, 2011

(54) FRONT-LOADING WASHING MACHINE HAVING LIQUID DISTRIBUTING PADDLES

(75) Inventors: Jaime Andia Laborda, Berlin (DE); Jonathan Murrell, Ernul, NC (US); Terry Smith, New Bern, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 621 days.

(21) Appl. No.: 12/008,589

(22) Filed: Jan. 11, 2008

(65) Prior Publication Data

US 2009/0178443 A1 Jul. 16, 2009

(51) Int. Cl.

| | |
|---|---|
| ***D06F 39/04*** | (2006.01) |
| ***D06F 39/08*** | (2006.01) |
| ***D06F 15/00*** | (2006.01) |

(52) U.S. Cl. ..... 68/12.19; 68/48

(58) Field of Classification Search ..... 68/48, 12.19
See application file for complete search history.

(56) References Cited

U.S. PATENT DOCUMENTS

| | | | | |
|---|---|---|---|---|
| 6,386,004 | B2 | 5/2002 | Salein | |
| 6,463,767 | B2 | 10/2002 | Uzkureit et al. | |
| 2002/0083743 | A1 * | 7/2002 | Uszkureit et al. | 68/58 |
| 2009/0007600 | A1 | 1/2009 | Cimetta et al. | |

FOREIGN PATENT DOCUMENTS

| | | | |
|---|---|---|---|
| DE | 3712118 | * | 11/1987 |
| EP | 1876282 | A1 | 1/2008 |

OTHER PUBLICATIONS

Machine translation of DE 3712118 (Nov. 1987).*

* cited by examiner

*Primary Examiner* — Michael Barr
*Assistant Examiner* — Charles W Kling
(74) *Attorney, Agent, or Firm* — James E. Howard; Andre Pallapies

(57) ABSTRACT

A washing machine paddle includes a plurality of intake openings for collecting liquid at the bottom and rear of a drum of a front loading washing machine. Discharge openings are located on the paddle toward the front of the drum for discharging liquid therethrough. A baffle arrangement in the paddle directs the liquid collected from the intake openings to the discharge openings upon rotation of the drum to place the paddle into a top location. A drum arrangement and washing machine includes at least one such paddle mounted thereon.

39 Claims, 4 Drawing Sheets

FRONT-LOADING WASHING MACHINE HAVING LIQUID DISTRIBUTING PADDLES

BACKGROUND OF THE INVENTION

1. Field of the Invention

The invention lies in the field of appliances. More specifically, the invention relates to a front-loading washing machine having a rotatable laundry drum with a casing, and with an axis of rotation in the operating position of the washing machine which deviates from the horizontal such that it slopes upward in the forward direction. The laundry drum has hollow, elongate paddles that are disposed on the inside of the casing. The paddles include liquid inlet openings located such that when located in a lower position as a result of drum rotation are proximate the rear region of the laundry drum. By such arrangement, upon rotation of the drum, the openings provide at the lowermost position admission of liquid into the paddle. A baffle arrangement redirects the liquid within the paddle to be discharged from the paddle through openings located toward the front of the drum when the paddle is in, or around, the upper most region of the drum during a rotation cycle.

2. Discussion of Prior Art

Prior art washing machines have included arrangements where laundry that is to be washed is exposed to washing liquid and moved mechanically to remove soiling on wash items. With drum-type washing machines, that function is performed by a laundry drum that is arranged essential horizontally in a tub. The drum is arranged for receiving the laundry and rotated to move the laundry in its interior. In order to assist in moving the laundry, rib-like paddles are aligned transverse to the movement direction of the laundry-drum casing.

Other prior art drum-type washing machines exist that position the paddles obliquely to run along a helical line on the inside of the laundry-drum casing. The paddles are arranged obliquely for the purpose of influencing the movement of the laundry. This causes the laundry to be transported by the paddles within the drum as the drum rotates.

One prior art approach which tends to distribute water throughout the laundry drum and in contact with the wash items involves having paddles arranged to scoop water in the lowermost region of the tub to raise the water as the laundry drum rotates to spray the water from a raised position, through openings onto the laundry located beneath. However, this configuration is such that the scooped quantity of liquid is discharged before the paddles have reached the position in which they are located essentially above the laundry. Such an arrangement slows the wetting process to a considerable degree because the liquid discharge only runs down the inner wall of the drum.

In an attempt to avoid such an occurrence, U.S. Pat. No. 6,463,767 discloses a front-loading washing machine which includes a laundry drum rotatably mounted around a rotation axis. The rotation axis slopes upward in a direction defined from the rear region to the front region. Hollow elongate paddles are disposed on the interior of the casing of the laundry drum in an oblique arrangement with respect to a direction of rotation. Each of the paddles includes liquid inlets which pass through a rear lower region of the laundry drum as a result of rotation to collect liquid and discharge it through outlets when the paddles are in an upper position within the drum. The drum is cylindrical and includes a casing line. Paddles are fastened on the inner casing of the drum cylinder and the inlets project outside of the casing line, i.e., beyond the drum, for scooping water into the paddles.

All the prior art discussed fails to address the desirability of directing water collected from the bottom of a rotating drum which is inclined, and redistributing the liquid in a manner consistently wetting laundry items within the drum at a location forward relative to the rear of the drum, such that laundry items towards the front of the drum are also uniformly exposed to washing liquid within the washing machine.

SUMMARY OF THE INVENTION

It is accordingly an object of the invention to provide a front-loading washing machine having a rotatable laundry drum that overcomes the previously mentioned disadvantages, and improves the wetting of the laundry, and the ability to reach the laundry with washing liquid within the washing machine.

With the foregoing and other objects in view, there is provided in accordance with one aspect of the invention, a paddle for a laundry drum which includes a hollow body which is open in a direction of an inner surface of a drum casing of the laundry drum when mounted within the laundry drum. A first plurality of openings which includes a distal opening is arranged on the hollow body at a position to pass adjacent the rear and bottom of the laundry drum when mounted on the laundry drum for gathering liquid collected at the rear and bottom of the laundry drum. At least one baffle member is provided within the hollow body which defines a channel within the hollow body for directing liquid gathered within the hollow body toward a position which passes adjacent the front of the laundry drum as the laundry body is moved toward the top of a laundry drum as a result of rotation thereof. A second plurality of openings which includes a proximal opening is provided located toward the front of the laundry drum, when the hollow body is mounted on the laundry drum, at a location for having liquid gathered by the hollow body directed toward the second plurality of openings when the drum is rotated to be located at or near the top, for having the liquid discharged through the second plurality of openings towards clothing located toward the front of the drum.

In an alternative aspect, the invention involves a laundry drum for a drum-type washing machine. The laundry drum includes a drum casing having an outer surface and an inner surface. At least one paddle is fastened on the inner surface of the drum casing. The paddle is made up of a hollow body open in a direction of the drum casing inner surface. A first plurality of openings on the hollow body is located at a position to pass adjacent a lower rear region of the casing for gathering liquid collected at the lower rear region of the casing. At least one baffle defines a channel within the hollow body for directing liquid gathered therein toward the front of the casing through the hollow body as it is moved toward the top of the laundry drum as a result of rotation thereof. A second plurality of openings is located toward the region of the body for having liquid gathered by the hollow body discharged therethrough toward a front region of the laundry drum, when the hollow body is moved by the drum casing into a position at or near the top.

In a yet still further aspect, there is provided a front-loading washing machine. The washing machine includes a laundry drum which is rotatably mounted about a rotation axis. The drum includes a drum casing having an outer surface and an inner surface, and a front region and a rear region. The rotation axis of the drum slopes upward in a direction defined from the rear region to the front region. At least one paddle is fastened on the inner surface of the drum casing. The paddle includes a hollow body open in the direction of the drum casing inner surface. A first plurality of openings on the hollow body is located at a position to pass adjacent to the rear region of the drum casing for gathering liquid collected at the rear region at the bottom thereof as a result of drum rotation. At least one baffle defines a channel within the hollow body for directing liquid gathered within the hollow body toward the front region of the drum as the hollow body is moved toward the top of the laundry drum as a result of rotation. A second plurality of openings is located toward the front region of the drum for having liquid gathered by the hollow body discharged therethrough when the hollow body is moved by the drum casing into a position near to or at the top of rotation.

As a result of the arrangement contemplated herein, the paddles transport quantities of liquid to a higher level than previously possible and direct the liquid towards the front of the laundry drum to ensure that all of the laundry articles within the drum are properly wetted.

In a more specific aspect, the drum rotates in a clockwise direction with the inlet openings of the first plurality of openings facing the direction of rotation to ensure water or liquid is collected within the paddle, transported upwardly upon rotation and then directed toward the front of the paddles to be discharged through the second plurality of openings at a location toward the front of the drum.

Other features that are considered as characteristic of the invention are set forth in the appended Claims.

Although the invention is illustrated and described herein as embodied in a front-loading washing machine having a rotatable laundry drum, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of the specific embodiments when read in connection with the accompanying Drawings.

DESCRIPTION OF THE PREFERRED EMBODIMENTS

Figure 1:
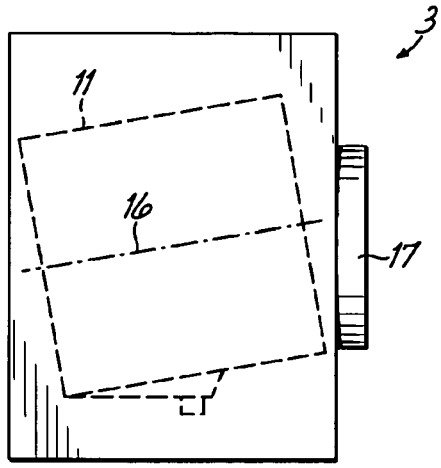
FIG. 1 is a side view of a front-loading drum type washing machine showing in dashed lines a drum arrangement within the washing machine.

Referring now to the figures of the Drawings in detail and first, particularly to FIG. 1 thereof, there is shown a front-loading washing machine 3 having a laundry drum subassembly 11 mounted about a drum axis of rotation 16 which is slightly inclined from rear to front in an upward direction relative to a horizontal line. The washing machine 3 includes a front-loading opening 17. The drum subassembly 11 is arranged to rotate about the axis 16.

The drum subassembly 11 is a rotatable drum and is provided with a plurality of paddles that are described in more detail hereinafter. Each paddle has a body element mountable in a rotatable drum that rotates about the drum axis 16, a distal opening, and a promixal opening. The body element of each paddle has an interior and the body element has an axial extent bi-sected by a mid-axial line and formed by a distal portion extending from the mid-axial line to a distal axial end and a proximal portion extending from the mid-axial line to a proximal axial end. The body element of each paddle is mountable on an inner surface of the drum subassembly 11 with the distal axial end thereof oriented toward one axial end of the drum subassembly 11 and the proximal axial end thereof oriented toward an opposite axial end of the drum subassembly 11. The distal opening in the distal portion of the body element of each paddle is operable to receive liquid therethrough for entry of liquid into the interior of the body element. The proximal opening in the proximal portion of the body element is operable for the passage of liquid therethrough such that liquid can exit the interior of the body element. The proximal opening and the distal opening is in communication with one another such that, as the drum subassembly 11 rotates about the drum axis 16, liquid enters the interior of the body element via the distal opening, flows within the interior of the body element to the proximal opening, and exits the body element via the proximal opening.

Figure 2:
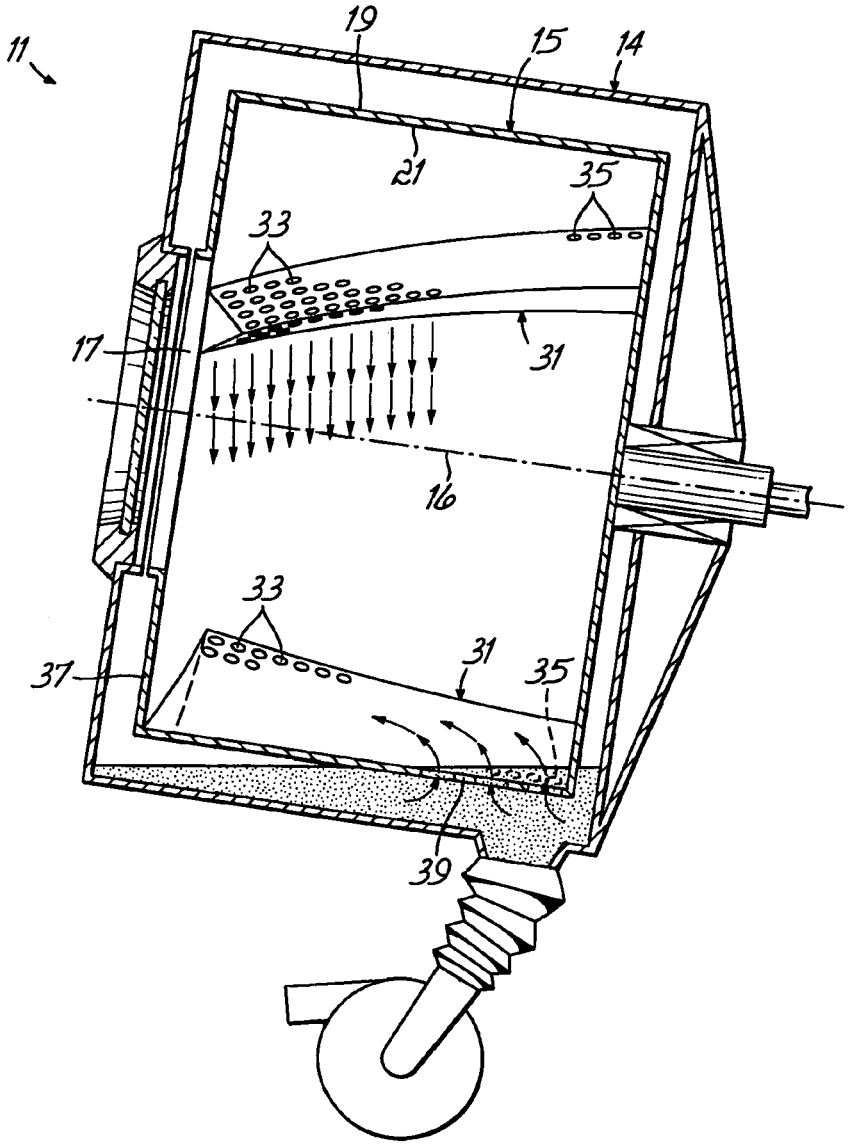
FIG. 2 is a side cross-sectional view of a subassembly of a washing machine according to the invention, including a tub and laundry drum.

FIG. 2 illustrates in greater detail the drum subassembly 11 which includes a tub 14 and a laundry drum 15 including an outer surface 19 and an inner surface 21. Paddles 31 in accordance with the invention are located therein and include intake openings 35 shown in dashed lines in the paddle 31 located at the bottom of drum 15 and in solid lines in the paddle 31 located at the top of the drum 15, and which face in the direction of rotation of the drum 15, i.e., clockwise for scooping in liquid 41 such as water, detergent or a combination of both, located at the bottom rear portion 39 of the drum 15. As may be appreciated from the drawing, as the drum rotates, the paddles 31 scoop in the liquid and when the paddle 31 is raised to a position close to or at the top of the drum 15, the liquid 41 is discharged through discharge openings 33 at a location close to the front 37 of the drum 15.

Figure 3:
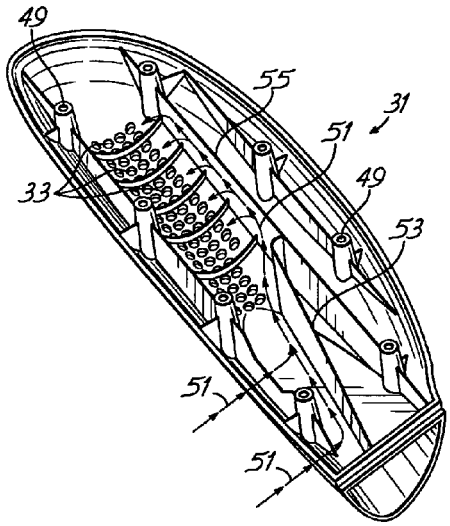
FIG. 3 is a perspective view of a paddle in accordance with the invention, shown from the hollow side thereof, and indicating liquid flow collected at a bottom location in a rotating drum.

FIG. 3 illustrates a paddle 31 in accordance with the invention, the drawing illustrates liquid or water flow 51 as directed, after intake into the paddle, through baffles 53 and 55. As may be appreciated, the paddle 31 is illustrated in an upside down arrangement, and because of the view angle the inlet openings 35 are not shown, but the discharge openings 33 are clearly illustrated. In addition, through-holes 49 are provided to facilitate mounting of the paddle 31, preferably through a stake-welding technique. As will be readily apparent to those of ordinary skill, alternative attachment techniques can be employed, including without limitation screws and the like.

Figure 4:
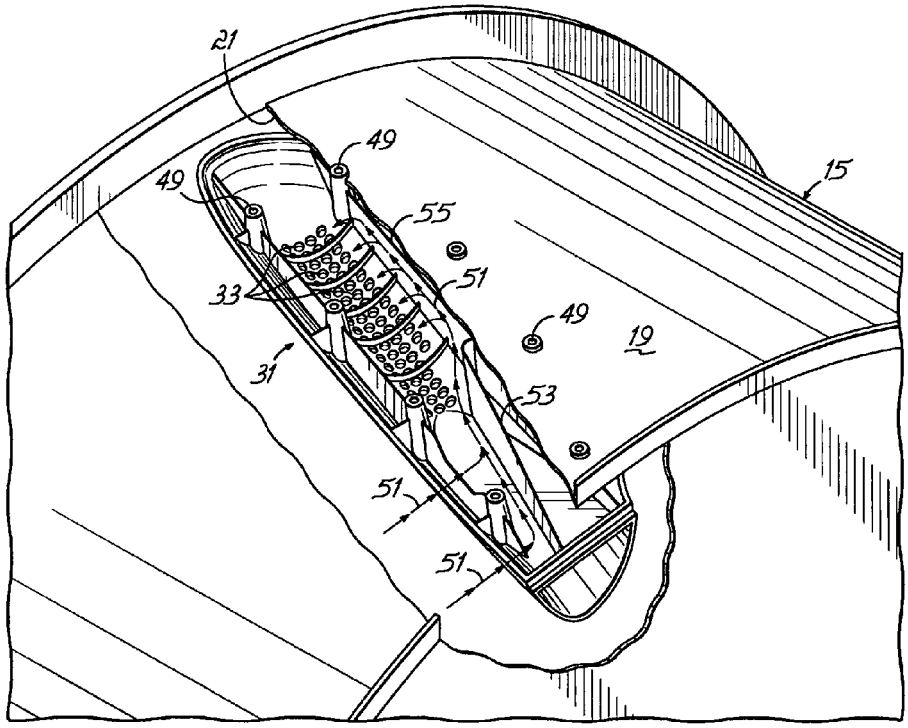
FIG. 4 is a view similar to FIG. 3, showing a paddle mounted on a drum at a top location, and showing a liquid flow for discharge therefrom.

As further illustrated in FIG. 4, the paddle 31 is shown attached to the inside surface 21, in a partial cut away view of laundry drum 15. As shown therein, it is also appreciated how the liquid 51 flows as guided by the baffles 53 and 55. More specifically, the liquid as it has been taken into the paddle 31, due to gravity, is maintained away from the discharge openings 33 until the paddle 31 arrives at a location close to or at the top of the drum 15 rotation.

Figure 5:
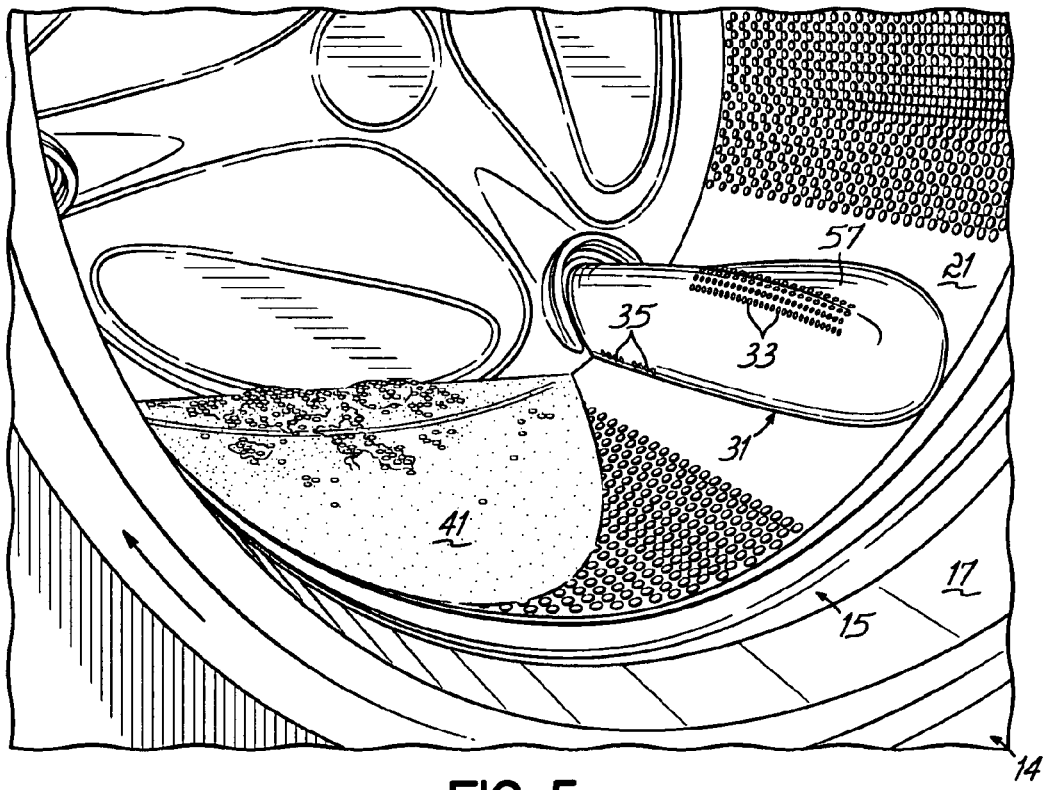
FIG. 5 is a perspective view showing a paddle in accordance with the invention approaching liquid at the bottom of a laundry drum for collecting liquid therein.
Figure 6:
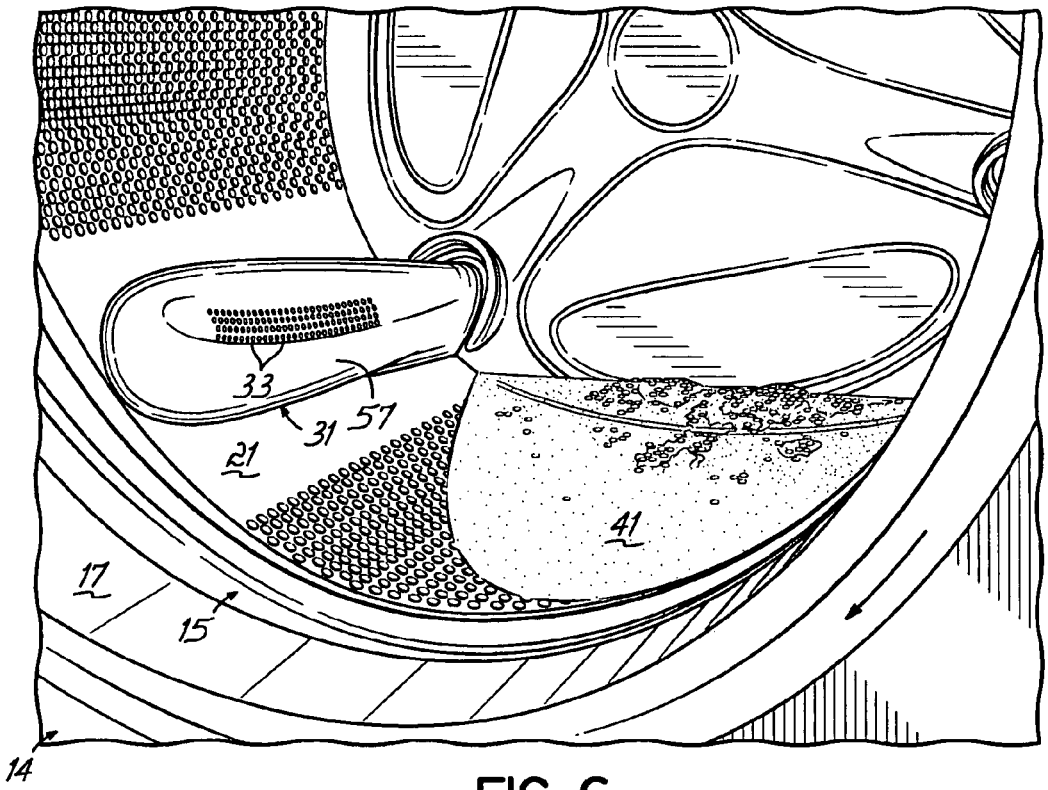
FIG. 6 is a view as in FIG. 5 but showing the paddle after having collected liquid at the bottom of the drum.
Figure 7:
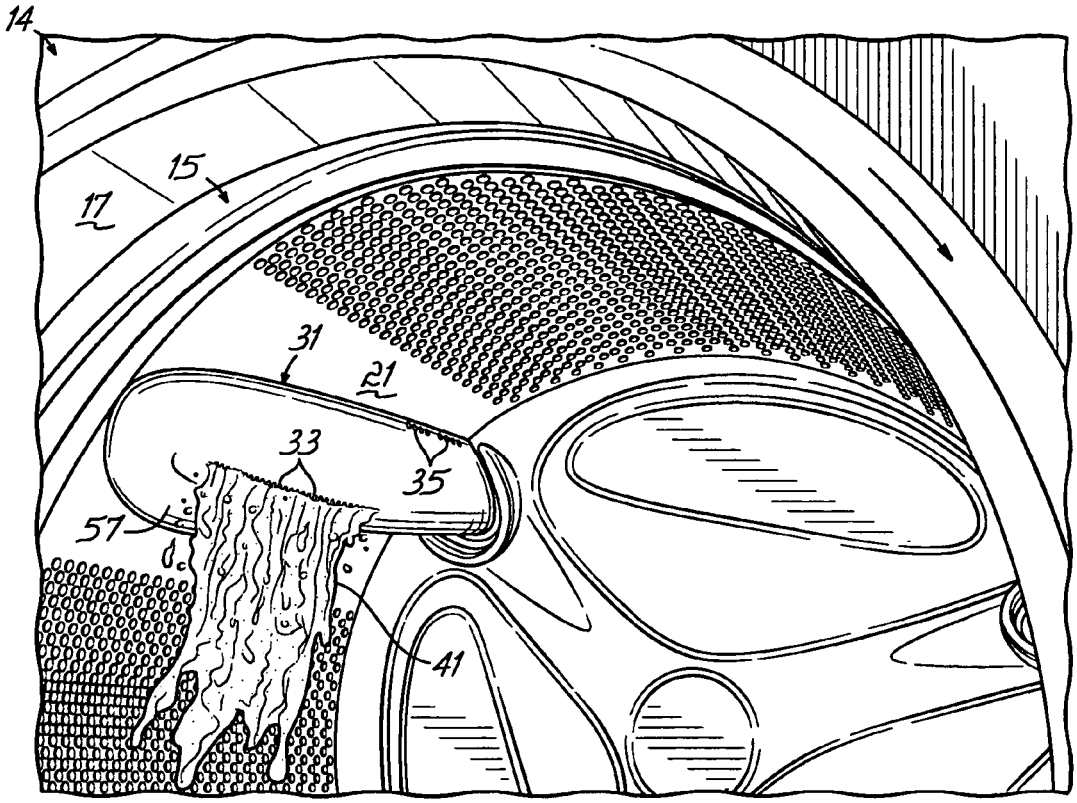
FIG. 7 is a view showing the paddle rotated into a upward position within the drum, and discharging liquid toward a location at the front of the drum as a result of rotation.

FIG. 5 illustrates in greater detail a paddle 31 as the drum 15 is rotated arriving at a location towards the bottom of the washing machine in which the liquid 41 is collected through openings 35. Thereafter, in the view of FIG. 6, the paddle 31 is shown after having been passed through the liquid 41. While the paddle is generally of V-shaped cross-section, it can also include an elongated, flattened section 57 which aids in retaining liquid 41 therein away from discharge openings 33 as the paddle is rotated clockwise upwardly within the washing machine 3. The paddle 31 then arrives at a location near the top of the washing machine due to the drum 15 rotation, as shown in FIG. 7, and the liquid 41 is discharged through openings 33 towards the front 37 of the drum 15, as shown in FIG. 7.

The paddles 31, may be made of a number of different materials. Plastics make manufacturing of the paddles 31 particularly easy through conventional molding or injection processes. In addition, depending on the type of plastics employed, they are advantageously suited for use in wet environments having large temperature variations such as occurs in washing machines.

In terms of mounting arrangements, the paddle 31 may be mounted transverse to the direction of rotation of the drum 15. Alternatively, the paddles 31 may be mounted oblique to the direction of rotation with appropriate placement of discharge openings 33, inlet openings 35 and baffles 51 and 53 to achieve the function described.

It will be understood that various details of the present invention may be changed without departing from the scope of the present invention. Furthermore, the foregoing description is for the purpose of illustration only, and not for the purpose of limitation, as the present invention is defined by the claims as set forth hereinafter.

What is claimed is:

1. A paddle for a washing machine drum, comprising:

a hollow body open in a direction of an inner surface of a washing machine drum when mounted on the washing machine drum;

a first plurality of openings on the hollow body at a position adjacent the rear of the laundry drum when mounted on the laundry drum for gathering liquid collected at the rear and bottom of the washing machine drum;

at least one baffle positioned within the hollow body and defining a channel within the hollow body for directing liquid gathered within the hollow body toward a position adjacent the front of the washing machine drum as the hollow body is moved toward the top of the washing machine drum as a result of rotation thereof; and a second plurality of openings on the hollow body and located toward the front of the washing machine drum when mounted on the washing machine drum, said second plurality of openings being positioned at a location for having liquid gathered by the hollow body directed toward the second plurality of openings when the drum is rotated to locate the hollow body at or near the top of the drum, for having the liquid discharged through the second plurality of openings toward the front of the washing machine drum.

2. The paddle of claim 1, wherein the paddle is of a generally V-shaped cross-section.

3. The paddle of claim 2, wherein the paddle is of V-shaped cross-section having a flattened extension adjacent the second plurality of openings.

4. The paddle of claim 1, wherein the paddle is removably securable to the inside of the washing machine drum.

5. The paddle of claim 1, further comprising mounting stakes for securing the paddle to the inside of the washing machine drum.

6. The paddle of claim 1, wherein the first plurality of openings is located on a side of the paddle facing the direction of rotation of the paddle when mounted on the washing machine drum.

7. The paddle of claim 1, wherein the second plurality of openings is located facing the axis of rotation of the washing machine drum when mounted thereon.

8. The paddle of claim 1, wherein the hollow body is defined by a common exterior wall that includes the first plurality of openings and the second plurality of openings.

9. The paddle of claim 8, wherein the first plurality of openings is positioned on a leading side of the common exterior wall oriented towards a direction of rotation of the washing machine drum.

10. The paddle of claim 1, wherein the baffle is positioned adjacent the first plurality of openings, and extends towards the second plurality of openings to direct the liquid in a generally axial direction from the rear towards the front of the laundry drum.

11. The paddle of claim 1, wherein the hollow body includes a rear section including only said first plurality of openings, a front section including only said second plurality of openings, and a central section extending from the rear section to the front section that does not include either the first or the second plurality of openings.

12. The paddle of claim 11, wherein the first and second plurality of openings are not located in a common plane as seen in cross section.

13. The paddle of claim 1, wherein the baffle extends in a direction that is generally along a back-to-front direction of the washing machine drum, the baffle having an edge that intersects an interior surface of the hollow body and is oriented generally along the back-to-front direction.

14. The paddle of claim 1, wherein a distal part of the baffle is located relatively close to the first plurality of openings and a proximal part of the baffle is oriented such that the baffle is angled relative to a longitudinal axis of the hollow body.

15. A laundry drum for a drum type washing machine, the laundry drum comprising:

an outer surface and an inner surface;

at least one paddle fastened on the inner surface of the drum, the paddle comprising:

a hollow body open in a direction of the drum inner surface;

a first plurality of openings on the hollow body at a position to be located adjacent a lower rear region of the drum for gathering liquid collected at the lower rear region of the drum;

at least one baffle positioned within the hollow body and defining a channel within the hollow body for directing liquid gathered within the hollow body toward the front of the drum through the hollow body as the hollow body is moved toward the top of the drum as a result of rotation thereof; and a second plurality of openings on the hollow body located toward the front region of the drum for having liquid gathered by the hollow body discharged therethrough when the hollow body is moved by the drum into a top position.

16. The laundry drum of claim 15, wherein the paddle is of a generally V-shaped cross-section.

17. The laundry drum of claim 16, wherein the paddle is of V-shaped cross-section having a flattened extension adjacent the second plurality of openings.

18. The laundry drum of claim 15, wherein the paddle is removably securable to the inside of the laundry drum.

19. The laundry drum of claim 15, further comprising through-holes for securing the paddle to the inside of the laundry drum.

20. The laundry drum of claim 15, wherein the first plurality of openings is located on a side of the paddle facing the direction of rotation of the paddle when mounted on the washing machine drum.

21. The laundry drum of claim 15, wherein the second plurality of openings is located facing the axis of rotation of the washing machine drum when mounted thereon.

22. The laundry drum of claim 15, wherein the first plurality of openings is provided on a side of the paddle positioned within a casing line of the laundry drum.

23. The laundry drum of claim 15, wherein the hollow body is defined by a common exterior wall that includes the first plurality of openings and the second plurality of openings.

24. The laundry drum of claim 23, wherein the first plurality of openings is positioned on a leading side of the common exterior wall oriented towards a direction of rotation of the washing machine drum.

25. The laundry drum of claim 15, wherein the baffle is positioned adjacent the first plurality of openings, and extends towards the second plurality of openings to direct the liquid in a generally axial direction from the rear towards the front of the laundry drum.

26. The laundry drum of claim 15, wherein the hollow body includes a rear section including only said first plurality of openings, a front section including only said second plurality of openings, and a central section extending from the rear section to the front section that does not include either the first or the second plurality of openings.

27. The laundry drum of claim 26, wherein the first and second plurality of openings are not located in a common plane as seen in cross section.

28. The laundry drum of claim 15, wherein the baffle extends in a direction that is generally along a back-to-front direction of the drum, the baffle having an edge that intersects an interior surface of the hollow body and is oriented generally along the back-to-front direction.

29. The laundry drum of claim 15, wherein a distal part of the baffle is located relatively close to the first plurality of openings and a proximal part of the baffle is oriented such that the baffle is angled relative to a longitudinal axis of the hollow body.

30. A paddle for a rotatable drum, comprising:

a body element mountable in a rotatable drum that rotates in a rotation direction about a drum axis, the body element having an interior and having an axial extent bisected by a mid-axial line and formed by a distal portion extending from the mid-axial line to a distal axial end and a proximal portion extending from the mid-axial line to a proximal axial end, and the body element being mountable on an inner surface of a rotatable drum with the distal axial end thereof oriented toward one axial end of the rotatable drum and the proximal axial end thereof oriented toward an opposite axial end of the rotatable drum;

a distal opening in the distal portion of the body element, the distal opening being operable to receive liquid therethrough for entry of liquid into the interior of the body element; and a proximal opening in the proximal portion of the body element, the proximal opening being operable for the passage of liquid therethrough such that liquid can exit the interior of the body element, the proximal opening and the distal opening being in communication with one another such that, as the rotatable drum rotates about the drum axis, liquid enters the interior of the body element via the distal opening, flows along a baffle within the interior of the body element to a water holding section that is positioned laterally adjacent to the proximal opening, the water holding section being located along an interior surface and upstream of the proximal opening relative to the rotation direction, whereupon the liquid subsequently moves from the holding section to the proximal opening to exit the body element via the proximal opening.

31. The paddle of claim 30, wherein the paddle is of a generally V-shaped cross-section.

32. The paddle of claim 31, wherein the paddle is of V-shaped cross-section having a flattened extension adjacent the distal opening thereof.

33. The paddle of claim 30, wherein the paddle is removably securable to the inside of the rotatable drum.

34. The paddle of claim 30 and further comprising mounting stakes for securing the paddle to the inside of the rotatable drum.

35. The paddle of claim 30, wherein the distal opening is located on a side of the paddle facing a direction of rotation of the paddle when mounted on the rotatable drum.

36. The paddle of claim 30, wherein the body element is defined by a common exterior wall that includes the distal opening and the proximal opening.

37. The paddle of claim 36, wherein the distal opening is positioned on a leading side of the common exterior wall oriented towards a direction of rotation of the rotatable drum.

38. The paddle of claim 30, wherein the baffle is positioned adjacent the distal opening the baffle extending from the distal portion towards the proximal portion to direct liquid in a generally axial direction from the distal opening to the proximal opening.

39. The paddle of claim 30 wherein the distal opening includes a plurality of openings.

* * * * *